United States Patent [19]

Reggel et al.

[11] 3,993,455

[45] Nov. 23, 1976

[54] REMOVAL OF MINERAL MATTER INCLUDING PYRITE FROM COAL

[75] Inventors: Leslie Reggel, Pittsburgh; Raphael Raymond, Bethel Park; Bernard D. Blaustein, Pittsburgh, all of Pa.

[73] Assignee: The United States of America as represented by the Secretary of the Interior, Washington, D.C.

[22] Filed: June 25, 1973

[21] Appl. No.: 354,023

[52] U.S. Cl. ..... 44/1 R; 201/17; 423/461

[51] Int. Cl.[2] ..... C10L 9/10; C10B 57/00; C01B 31/02

[58] Field of Search ..... 44/1 R; 201/17; 423/461

[56] References Cited

UNITED STATES PATENTS

| | | | |
|---|---|---|---|
| 200,663 | 11/1877 | Morey | 44/1 A |
| 2,162,221 | 6/1939 | Kasehagen et al. | 44/1 R |
| 2,346,151 | 4/1944 | Burk et al. | 44/1 R |
| 2,739,105 | 3/1956 | Ford et al. | 201/17 X |
| 2,878,163 | 3/1959 | Hutchings | 201/17 X |
| 3,214,346 | 10/1965 | Mason et al. | 201/17 X |
| 3,393,978 | 7/1968 | Murphy et al. | 201/17 X |

*Primary Examiner*—Carl F. Dees

*Attorney, Agent, or Firm*—William S. Brown; Donald R. Fraser

[57] ABSTRACT

Mineral matter, including pyrite, is removed from coal by treatment of the coal with aqueous alkali at a temperature of about 175° to 350° C, followed by acidification with strong acid.

3 Claims, No Drawings

REMOVAL OF MINERAL MATTER INCLUDING PYRITE FROM COAL

Low-sulfur coals, suitable for use by coal-powered electric utilities, are in short supply, particularly in the eastern part of the country. Removal of sulfur from coal is therefore one of the most pressing needs in the related fields of energy and clean environment.

Sulfur in coal occurs mainly as pyrite, $FeS_2$, and as organic sulfur, which is part of the coal structure. Since the pyrite generally makes up about 40 to 80 percent of the total sulfur, and comprises about 1 to 10 percent of the coal, removal of pyritic sulfur can obviously result in a substantial reduction of the sulfur content of the coal.

In addition, coals contain mineral matter (usually reported as "ash" in the analysis) other than pyrite in amounts generally ranging from 2 to 40 percent. This mineral matter consists of a variety of non-combustible inorganic constituents such as kaolinite and other clay minerals, quartz, and gypsum, and its presence results in lowered fuel value of the coal.

It is, accordingly, an object of the invention to affect a substantial reduction of pyrite, and other mineral matter, in coal, in order to provide a clean coal with low sulfur content, low ash analysis and high fuel value. Prior art processes based on physical separation are relatively inefficient and involve considerable loss of the starting coal. Chemical methods have also been used to remove pyrite from coal, but these methods do not lower the non-pyritic mineral matter content appreciably.

It has now been found, according to the process of the invention, that the above objective may be achieved by treatment of the coal with aqueous alkali at slightly elevated temperature, followed by acification with a dilute strong acid.

The feed material in the process of the invention may be any coal containing a substantial proportion of pyritic sulfur and/or other mineral matter. This will usually be a bituminous coal having a pyritic sulfur, and ash, content as discussed above, although the process may be applicable to coals of other ranks. It is preferably employed in a finely divided form, e.g., minus 200 mesh, but coal up to ¼ inch in particle size may be used. Suitable particle size reduction may be achieved by conventional techniques such as grinding, pulverizing, etc.

The preferred aqueous alkali consists of an aqueous solution of sodium hydroxide, although solutions of other alkalis such as potassium hydroxide may also be used. In the case of NaOH, the concentration may vary over a range of about 50 to 420 grams per liter. Optimum concentration of the alkali will, however, depend on the composition of the particular coal, i.e., the pyrite and mineral matter content, state of subdivision of the coal, amount of aqueous alkali, temperature, etc., and is best determined experimentally.

The ratio of the amount of coal to the amount of alkali solution may also vary over a considerable range, with about 40 to 200 grams of coal per liter of alkali solution generally being suitable. A dispersion of the coal in the solution is prepared and maintained during the course of the reaction by conventional means, such as stirring.

Temperature of the aqueous alkali treatment is suitably from about 175° to 350° C., preferably about 225° C., in a closed vessel having an inert atmosphere. Optimum reaction time will also vary with the above variables, and may vary from about 15 minutes to 6 hours. Generally, however a reaction time of about 2 hours is preferred in this step, in which we believe the pyritic sulfur is dissolved.

The reaction may be carried out in any conventional reaction vessel that is capable of providing the required temperature and pressure, as well as being resistant to the corrosive effects of the alkali. Examples of suitable reaction vessels are stirred autoclaves or rocking autoclaves.

Following the reaction of the coal with aqueous alkali, the reaction mixture is cooled to approximately room temperature and acidified with a dilute solution of a strong acid. The amount and concentration of the acid should be sufficient to adjust the pH of the reaction mixture to about 2 or less. The preferred acid is sulfuric acid, in a concentration of about 6 normal. However, other acids such as hydrochloric acid or $SO_2$ may also be used in concentrations sufficient to provide similar pH values. Weak acids such as carbonic, are not effective since they do not result in a product having the desired low ash analysis.

Agitation of the reaction mixture is performed during and after addition of the acid, for a time sufficient to permit reaction of the acid with ingredients in the mixture. It is believed that these ingredients include some of the constituents originally present in the acid-insoluble portion of the mineral matter of the coal, which constituents have now been transformed into an acid-soluble form as a result of treatment with the alkali. Usually a reaction time of about 30 minutes to 6 hours is sufficient.

Following reaction with the acid, the reaction mixture is filtered or centrifuged and washed with water to recover the product coal of low mineral matter and pyrite content. Such a coal is highly desirable for combustion in generation of electricity, e.g., in steam plants, gas turbines or MHD (magnetohydrodynamic) generators. It would also extend the life of catalysts used for catalytic hydrodesulfurization of coal.

EXAMPLE 1

30 grams of minus 200 mesh Illinois No. 6 high volatile B bituminous coal was treated with a solution of 24 grams of sodium hydroxide in 240 milliliters of water for 2 hours at 225° C in a stirred autoclave. The reaction mixture was cooled to room temperature and acidified with 125 milliliters of 6 N sulfuric acid. The product coal was isolated by centrifugation and decantation of the supernatant aqueous layer. This was followed by repeatedly stirring the coal with water, aspiration of the aqueous layer, and centrifugation, until the aqueous layer gave only a very faint test for sulfate ion with barium chloride solution. The product coal was then dried and analyzed for ash and pyritic sulfur contents, and for heating value. Ash and pyritic sulfur contents were found to be 0.5 percent and 0.2 percent, respectively, and the coal had a heating value of 14000 Btu per pound, on a moisture-free basis.

By comparison, the starting coal contained 9.8 percent ash and 1.0 percent pyritic sulfur, and had a heating value of 12400 Btu per pound, on a moisture-free basis.

EXAMPLE 2

30 grams of minus 200 mesh Illinois No. 6 high volatile B bituminous coal was treated with a solution of 24 grams of sodium hydroxide in 240 milliliters of water for 2 hours at 225° C in a stirred autoclave. The reaction mixture was then cooled to room temperature and the product coal filtered with suction on a Buchner funnel. The coal was then transferred to a beaker and water added to make a total volume of 800 milliliters. The mixture was then acidified by bubbling in sulfur dioxide gas for 3 hours with stirring. The product coal was isolated by centrifugation and aspiration of the supernatant aqueous layer. This was followed by repeatedly stirring the coal with water, aspiration of the aqueous layer, and centrifugation, until the aqueous layer gave only a very faint test for sulfite ion with barium chloride solution. The product coal was then dried and analyzed for ash and pyritic sulfur contents. Ash and pyritic sulfur contents were found to be 0.7 percent and 0.1 percent, respectively, on a moisture-free basis.

By comparison, the starting coal contained 12.7 percent ash and 1.1 percent pyritic sulfur, on a moisture-free basis.

We claim:

1. A method for treating coal to lower pyrite and mineral matter content comprising (1) forming a slurry of the finely divided coal in an aqueous alkali solution, said slurry containing about 40 to 200 grams of coal per liter of alkali solution, (2) maintaining said slurry at a temperature of about 225° C for a period of about 15 minutes to 6 hours, (3) cooling the resulting reaction mixture to about room temperature, (4) acidifying the reaction mixture with a dilute solution of a strong acid to a pH of about 2 or less, (5) agitating the acidified reaction mixture for a period of about 30 minutes to 6 hours, and (6) recovering particulate coal from said mixture, said coal having a reduced pyrite and mineral matter content.

2. The method of claim 1 in which the alkali is sodium hydroxide.

3. The method of claim 1 in which the acid is sulfuric acid.

* * * * *